US011479986B1

(12) United States Patent
Baggelaar et al.

(10) Patent No.: US 11,479,986 B1
(45) Date of Patent: Oct. 25, 2022

(54) POOL OVERFLOW DRAIN HEIGHTENER

(71) Applicant: Rocketfrog Designs, LLC, Sherman Oaks, CA (US)

(72) Inventors: William C. Baggelaar, Sherman Oaks, CA (US); Stacy Kapp Baggelaar, Sherman Oaks, CA (US)

(73) Assignee: Rocketfrog Designs, LLC, Sherman Oaks, CA (US)

( * ) Notice: Subject to any disclaimer, the term of this patent is extended or adjusted under 35 U.S.C. 154(b) by 0 days.

(21) Appl. No.: 17/651,039

(22) Filed: Feb. 14, 2022

(51) Int. Cl.
*E04H 4/12* (2006.01)

(52) U.S. Cl.
CPC ..... *E04H 4/12* (2013.01)

(58) Field of Classification Search
CPC ..... E04H 4/12; E03C 1/244
USPC ..... 4/508, 694
See application file for complete search history.

(56) References Cited

U.S. PATENT DOCUMENTS 1,531,322 A * 3/1925 Waechter ..... E03C 1/24 4/694
1,598,162 A * 8/1926 Solomon ..... E03C 1/22 4/694
2,113,043 A * 4/1938 Ehrhorn ..... E03C 1/22 4/694
8,627,519 B2 1/2014 Jacobs
10,519,681 B1 12/2019 Jacobs
2006/0070175 A1* 4/2006 Howard ..... E04H 4/12 4/508
2020/0256043 A1* 8/2020 Mills ..... E03C 1/244

FOREIGN PATENT DOCUMENTS

NL 7708221 1/1979

OTHER PUBLICATIONS

Eco Flow, Pool Overflow Top Drain Upgrade (White), https://www.amazon.com/Flow-Overflow-Drain-Upgrade-White/dp/B08H8S663Z?th=1.
Top Drain, Perfect Replacement for Overflows, https://topdrain.net.
Whatagate, Pool Overflow Drain Stopper, https://www.whatagate.com.

* cited by examiner

*Primary Examiner* — Christine J Skubinna
(74) *Attorney, Agent, or Firm* — UltimatEdge IP Law Group, P.C.; Dean G. Stathakis

(57) ABSTRACT

The present specification discloses a pool overflow drain heightener that prevents pool water from draining through the pool overflow drain during normal usage, yet permits draining during an emergency overflow event. The pool overflow drain heightener includes a dam basin having an upper rim that defines a mouth configured to be positioned above the desired water level and above the lowest point of the pool overflow drain, such that the water level can temporarily or permanently rise above the lowest point, yet not drain from the pool. Excessive water levels will still be able drain through the mouth, and out the overflow drain, thereby preventing overflow of the pool.

20 Claims, 6 Drawing Sheets

POOL OVERFLOW DRAIN HEIGHTENER

BACKGROUND

The subject of this patent application relates generally to overflow devices for preventing undesired water entry into swimming pool overflow drains during normal use.

Modernly, in-ground swimming pools comprise both a filtering system and an overflow drainage system. A pool filtering system functions to remove debris which accumulates through use as well as exposure to the environment. During normal operation, water circulates through the filtering system by the action of a pump which pulls water from the pool using one or more main drains at the bottom of the basin and multiple skimmer drains around the top ledge of the basin. Typically located on the lowest point in the pool, the main drain remove most of the dirt and debris that sinks to the pool bottom. The skimmers are designed to draw water from the top surface of the pool in order to remove floating debris like leaves, suntan oil, and hair. Water collected from the main and skimmer drains is pumped through a filter and clean water is returned to the pool using inlet values located around the side of the basin.

Pools are designed with a certain water capacity and typically have a designated fill line. Although many factors are considered when locating the fill line for a particular pool basin, water displacement due to use by individuals while in the water and other normal activities are considerations. A pool overflow drainage system functions to remove water that exceeds this capacity in order to maintain proper pool water levels and prevent flooding of the surrounding deck. A pool overflow drainage system comprises one or more overflow drains around the top ledge of the basin that remove excess water from the pool and carries the excess water to a municipal sewage system or other drainage site. The more common triggers for a pool overfill event include overfilling by the owner of the pool, heavy rainfall, and a malfunctioning or broken pool component that continually fills the pool.

One problem associated with a pool overflow drainage system pertains to the improper placement of the overflow drains. Ideally, overflow drains are positioned just below the coping of the pool, which lies just beneath the deck surface. However, pools are all too commonly constructed with overflow drains positioned in an improperly low location which results in several problems. One problem is that the pool basin cannot be completely filled to its designated water capacity resulting in a greater distance between the water level and the pool deck surface. This low water level makes is more difficult for a user to get out of the pool which minimally causes inconveniences but more seriously could become a safety hazard. Another problem related with improper overflow drain positioning is a loss of water which is unnecessarily drained during normal pool activities. Such water loss adds substantially to the cost of maintaining and using a pool as the pool constantly needs to be refilled for the adequate enjoyment of its users. However, repositioning overflow drains of a pool is impractical, as it would involve partial demolition of the pool wall. Thus, a means for repairing and retrofitting mispositioned overflow drains is needed.

Aspects of the present invention address the needs created by improper pool overflow drain positioning and provide further related advantages as described in the following summary.

SUMMARY

Aspects of the present invention teach certain benefits in construction and use which give rise to the exemplary advantages described below.

The present specification discloses a pool overflow drain heightener. In some aspects, the pool overflow drain heightener includes a dam basin, where the dam basin is configured to attach directly to a pool overflow drain. In some aspects, the pool overflow drain heightener includes a dam basin and a hollow drainpipe connector insert, where the hollow drainpipe connector insert is configured to attach directly to a pool overflow drain.

The dam basin includes a front wall, a first sidewall adjacent to and extending from the front wall, a second sidewall adjacent to and extending from the front wall and opposing the first sidewall, and a back wall opposing the front wall, a dam basin mouth at least partially defined by the front wall, the first sidewall, and the second sidewall, and an interior volume at least partially defined by the front wall, the first sidewall, the second sidewall, and the back wall. A dam basin disclosed herein can comprise a dam basin flange that extends from and surrounds the periphery of the front wall, the first sidewall, and the second sidewall. In some aspects, a dam basin flange is configured to contain attachment points that facilitate and/or enable securement of the pool overflow drain heightener to a pool overflow drain.

The hollow drainpipe connector insert is unitarily molded with or attachable to the dam basin and extends rearwardly from the back wall away from the interior volume, the hollow drainpipe connector insert including a proximal drain inlet formed through the back wall and in fluid communication with a distal drain outlet through an interior passage of the hollow drainpipe connector insert.

The dam basin mouth is configured to be in fluid communication with the interior volume, and the interior volume is configured to be in fluid communication with the proximal drain inlet, the interior passage, and the distal drain outlet of the hollow drainpipe connector insert.

Other features and advantages of aspects of the present invention will become apparent from the following more detailed description, taken in conjunction with the accompanying drawings, which illustrate, by way of example, the principle aspects of the invention.

BRIEF DESCRIPTION OF THE DRAWINGS

The accompanying drawings, which are incorporated in and constitute a part of this specification, illustrate aspects of the disclosed subject matter in at least one of its exemplary embodiments, which are further defined in detail in the following description. Features, elements, and aspects of the disclosure are referenced by numerals with like numerals in different drawings representing the same, equivalent, or similar features, elements, or aspects, in accordance with one or more embodiments. The drawings are not necessarily to scale, emphasis instead being placed upon illustrating the principles herein described and provided by exemplary embodiments of the invention. In such drawings.

Listing of Reference Numbers Associated with Drawings

| Ref. No. | Element |
|---|---|
| 20 | Pool overflow drain heightener |
| 22 | Dam basin component |
| 23 | Dam wall |
| 24 | Drainpipe component |
| 26 | Drainpipe attachment plate mounting portion |
| 28 | Dam basin mounting portion |
| 30 | Dam basin |
| 32 | Front wall |
| 34 | First sidewall |
| 36 | Second sidewall |
| 38 | Dam basin flange |
| 40 | Upper rim |
| 42 | Rear portion |
| 44 | Sealing face |
| 46 | Bottom sill |
| 48 | First groove |
| 49 | Second groove |
| 50 | Mouth |
| 52 | Inner side of front wall |
| 54 | Inner side of first sidewall |
| 56 | Inner side of second sidewall |
| 58 | Drainpipe attachment plate |
| 62 | First tongue |
| 63 | Second tongue |
| 64 | Hollow drainpipe connector insert |
| 66 | Interior passage |
| 68 | Wall of hollow drainpipe connector insert |
| 70 | Radiused leading edge |
| 72 | Proximal drain inlet |
| 74 | Distal drain outlet |
| 76 | Top edge |
| 78 | Bottom edge |
| 79 | Front face |
| 80 | Back face |
| 82 | Interior volume |
| h | Height |
| P | Pool |
| PS | Pool sidewall |
| O | Pool overflow drain |
| I | Inner wall |
| D | Pool deck |
| S | Water surface |
| W | Wave |

DETAILED DESCRIPTION

The present system in one or more embodiments provides a pool overflow drain heightener that prevents pool water from draining through the pool overflow drain during normal usage, yet permits draining during an emergency overflow event. In one or more embodiments, the pool overflow drain heightener includes a dam basin joined with a hollow drainpipe connector insert, where the hollow drainpipe connector insert is pushed into engagement within the drainpipe associated with pool overflow drain located in the pool sidewall. The dam basin includes an upper rim that defines a mouth configured to be positioned at or above the desired water level and above the lowest point of the pool overflow drain (and optionally, above the highest point of the pool overflow drain), such that the water level can temporarily or permanently rise above the lowest point, yet not drain from the pool. Excessive water levels can still drain through the mouth, and out the overflow drain during an overflow event like a heavy rain but prevent the needless water loss created by the improper location of the overflow drain. The hollow drainpipe connector insert firmly holds the pool overflow drain heightener in position on the pool wall.

Figure 2:
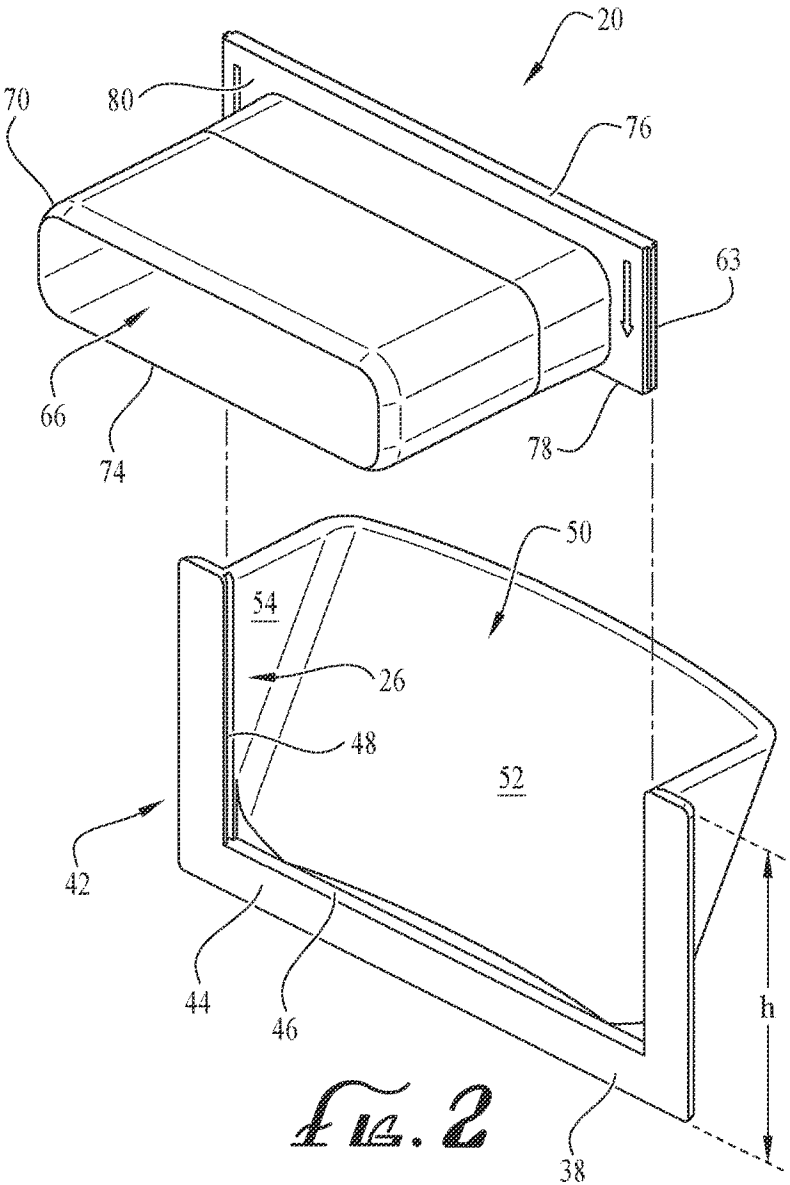
FIG. 2 is an exploded top back perspective view of the pool overflow drain heightener of FIG. 1.
Figure 1:
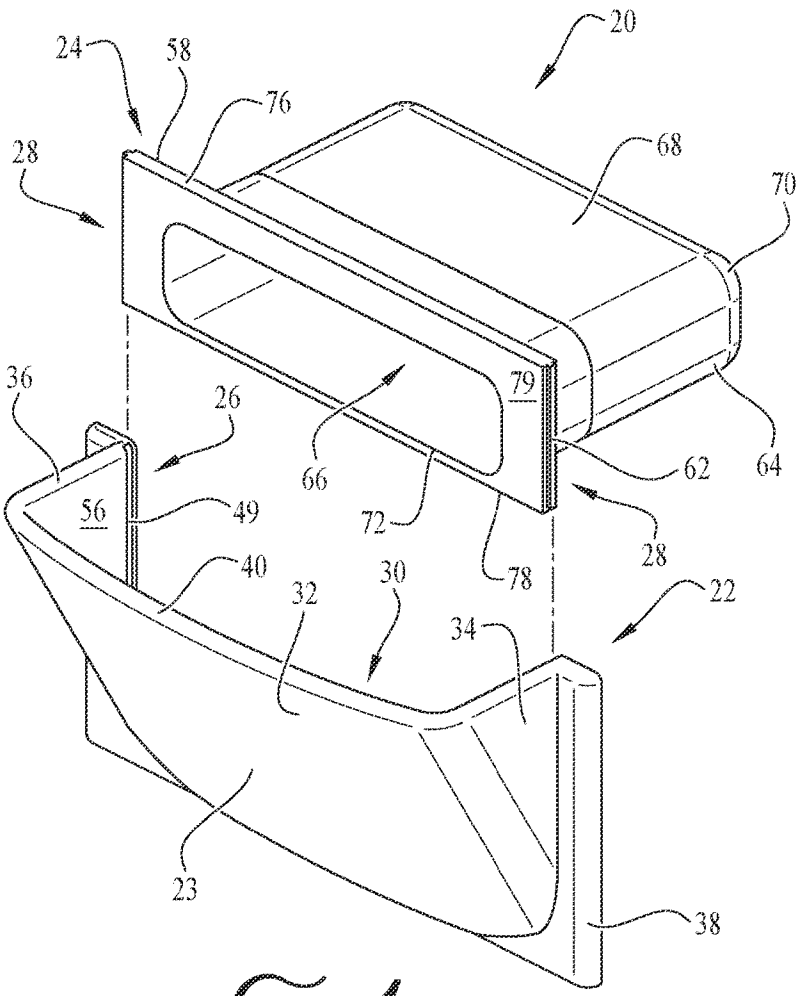
FIG. 1 is an exploded top, right, front perspective view of an exemplary embodiment of a pool overflow drain heightener disclosed herein.

An exemplary embodiment of the present pool overflow drain heightener 20 can be seen in FIGS. 1-11. In one or more embodiments, pool overflow drain heightener 20 generally includes a dam basin component 22. In one or more embodiments, and as best shown in FIGS. 1-2, dam basin component 22 includes a dam wall 23 having at least one side. Dam wall 23 is configured to prevent pool water from substantial entry into the overflow drain under normal pool use, e.g., as when water level rises above the lowest point of the overflow drain (i.e., the lowest point of the overflow drain would be the bottom of the pipe opening into the pool wall, where water will start to drain). In embodiments where pool overflow drain heightener 20 comprises only dam basin component 22 (i.e., a drainpipe component disclosed herein is not part of the pool overflow drain heightener 20), dam basin component 22 can be molded, or otherwise manufactured as a single unit and out of appropriate material, such as ABS plastic, PVC, stainless steel, and so on.

In one or more embodiments, and as best shown in FIGS. 1-9, pool overflow drain heightener 20 generally includes a dam basin component 22 detachable from, permanently attached to, or unitarily molded with a drainpipe component 24. In one or more embodiments, and referring to FIGS. 1, 3, 5, & 7-9, dam basin component 22 includes a dam wall 23 having at least one side. Dam wall 23 is configured to prevent pool water from substantial entry into the overflow drain under normal pool use, e.g., as when water level rises above the lowest point of the overflow drain (i.e., the lowest point of the overflow drain would be the bottom of the pipe opening into the pool wall, where water will start to drain). In one or more embodiments, and referring to FIGS. 1, 3, 6, & 7-9, drainpipe component 24 includes a hollow drainpipe connector insert 64 which inserts into the drainpipe of a pool overflow drain. One end of drainpipe component 24 is configured to attach to dam basin component 22 while the other end of drainpipe component 24 is configured to insert into the drainpipe of an overflow drain through hollow drainpipe connector insert 64.

In embodiments where a pool overflow drain heightener 20 comprises both dam basin component 22 and drainpipe component 23, dam basin component 22 and drainpipe component 24 can be molded, or otherwise manufactured, as a single unit or as two separate components, out of appropriate material, such as ABS plastic, PVC, stainless steel, and so on. However, it may be more practical and economical to make pool overflow drain heightener 20 out of two or more components molded separately, then slipped, inserted, welded, clipped, screwed, adhered, or otherwise temporarily or permanently connected together. In some embodiments, when dam basin component 22 and drainpipe component 24 are separate components, drainpipe component 24 is configured to slidably fit onto dam basin component 22. At least one advantage of separately molding the dam basin component 22 and the drainpipe component 24 is the ability to customize the pool overflow drain heightener 20 for a specific application. For example, dam basin component 22 can be provided in a kit with two or more dam basin components 22, where the height h of dam wall 23 for each dam basin component 22 is different (i.e., one higher than the other), so that the end user can choose the dam basin component 22 that most advantageously increases the height of the upper rim 40 above the lowest point of an overflow drain.

As shown in FIG. 2, height h of dam wall 23 is approximately measured from an upper rim 40 to a bottommost portion of dam wall 23. In one exemplary kit, one dam basin component 22 has dam wall 23 with height h of 6 inches and another dam basin component 22 has a dam wall 23 with height h of 8 inches. In some embodiments, wall height h can be at least 3 inches, at least 4 inches, at least 5 inches, at least 6 inches, at least 7 inches, at least 8 inches, at least 9 inches, at least 10 inches, at least 11 inches, or at least 12 inches. In some embodiments, wall height h can be at most 3 inches, at most 4 inches, at most 5 inches, at most 6 inches, at most 7 inches, at most 8 inches, at most 9 inches, at most 10 inches, at most 11 inches, or at most 12 inches. In some embodiments, wall height h can be at about 3 inches to about 4 inches, about 3 inches to about 5 inches, about 3 inches to about 6 inches, about 3 inches to about 7 inches, about 3 inches to about 8 inches, about 3 inches to about 9 inches, about 3 inches to about 10 inches, about 3 inches to about 11 inches, about 3 inches to about 12 inches, about 4 inches to about 5 inches, about 4 inches to about 6 inches, about 4 inches to about 7 inches, about 4 inches to about 8 inches, about 4 inches to about 9 inches, about 4 inches to about 10 inches, about 4 inches to about 11 inches, about 4 inches to about 12 inches, about 5 inches to about 6 inches, about 5 inches to about 7 inches, about 5 inches to about 8 inches, about 5 inches to about 9 inches, about 5 inches to about 10 inches, about 5 inches to about 11 inches, about 5 inches to about 12 inches, about 6 inches to about 7 inches, about 6 inches to about 8 inches, about 6 inches to about 9 inches, about 6 inches to about 10 inches, about 6 inches to about 11 inches, about 6 inches to about 12 inches, about 7 inches to about 8 inches, about 7 inches to about 9 inches, about 7 inches to about 10 inches, about 7 inches to about 11 inches, about 7 inches to about 12 inches, about 8 inches to about 9 inches, about 8 inches to about 10 inches, about 8 inches to about 11 inches, about 8 inches to about 12 inches, about 9 inches to about 10 inches, about 9 inches to about 11 inches, about 9 inches to about 12 inches, about 10 inches to about 11 inches, about 10 inches to about 12 inches, or about 11 inches to about 12 inches.

Figure 3:
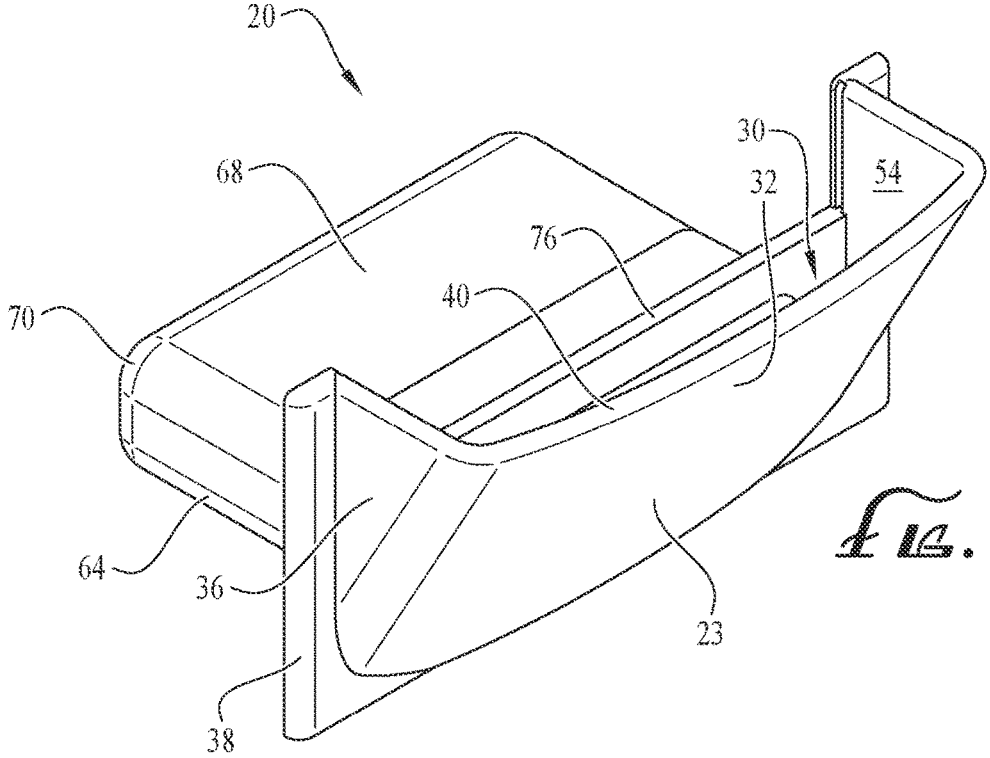
FIG. 3 is an assembled top, left, front perspective view of the pool overflow drain heightener of FIG. 1.
Figure 4:
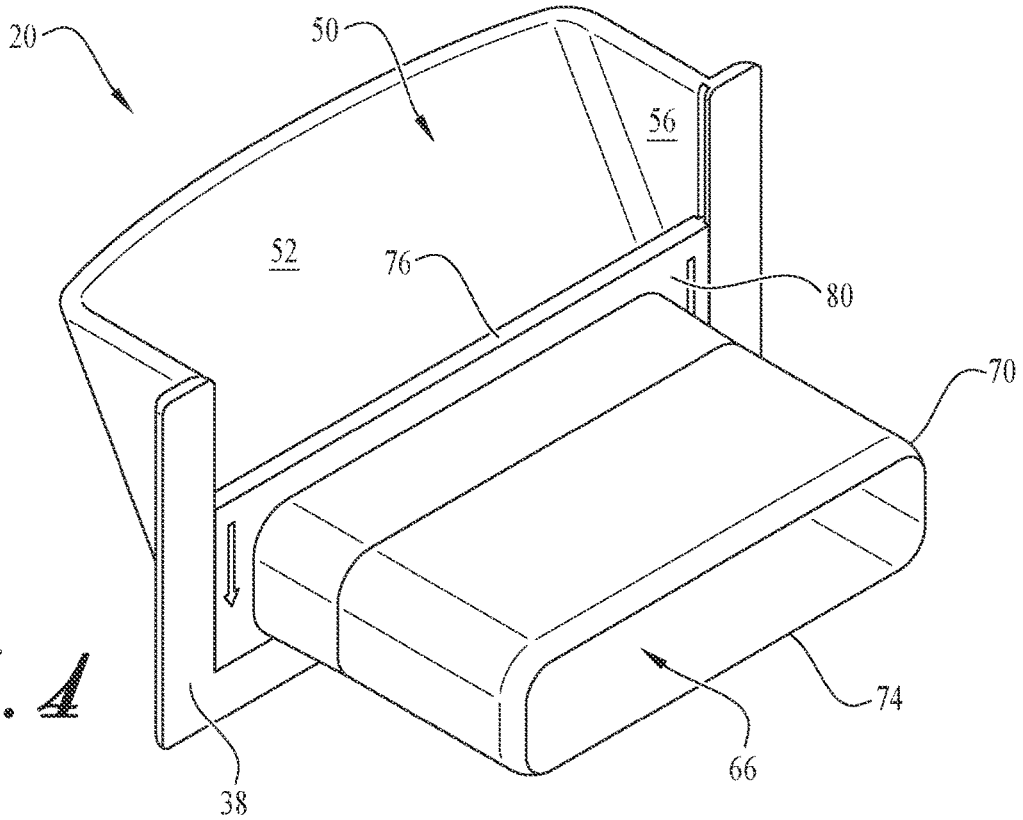
FIG. 4 is an assembled top, right, back perspective view of the pool overflow drain heightener of FIG. 1.
Figure 5:
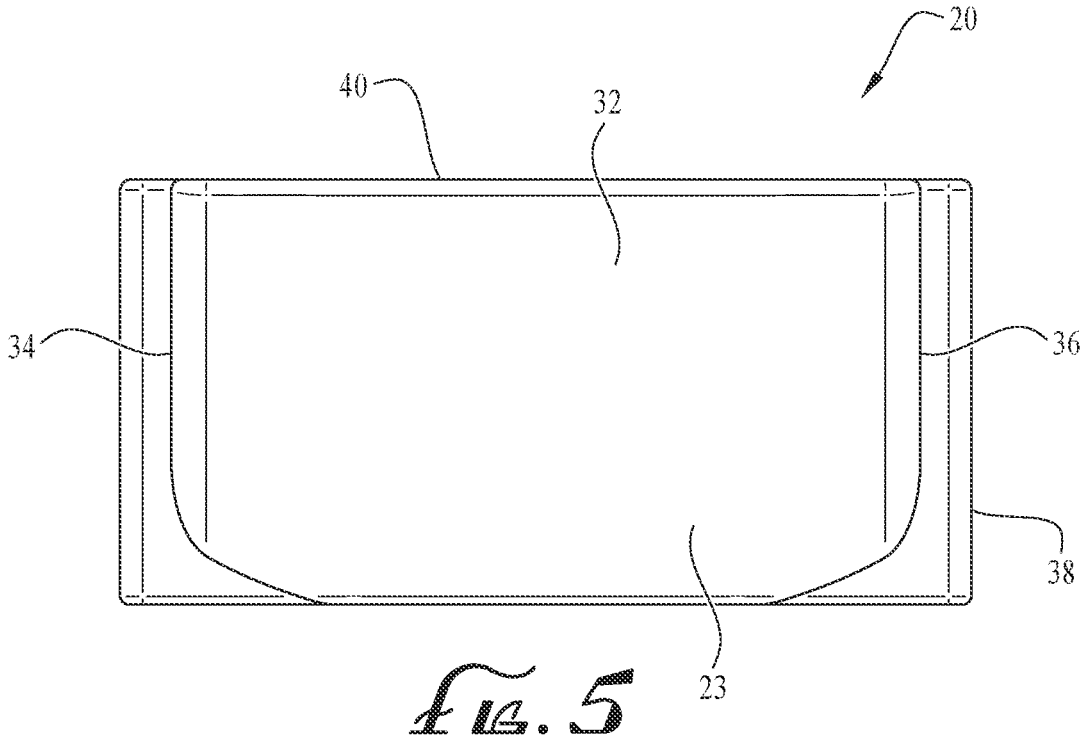
FIG. 5 is an assembled front view of the pool overflow drain heightener of FIG. 1.
Figure 7:
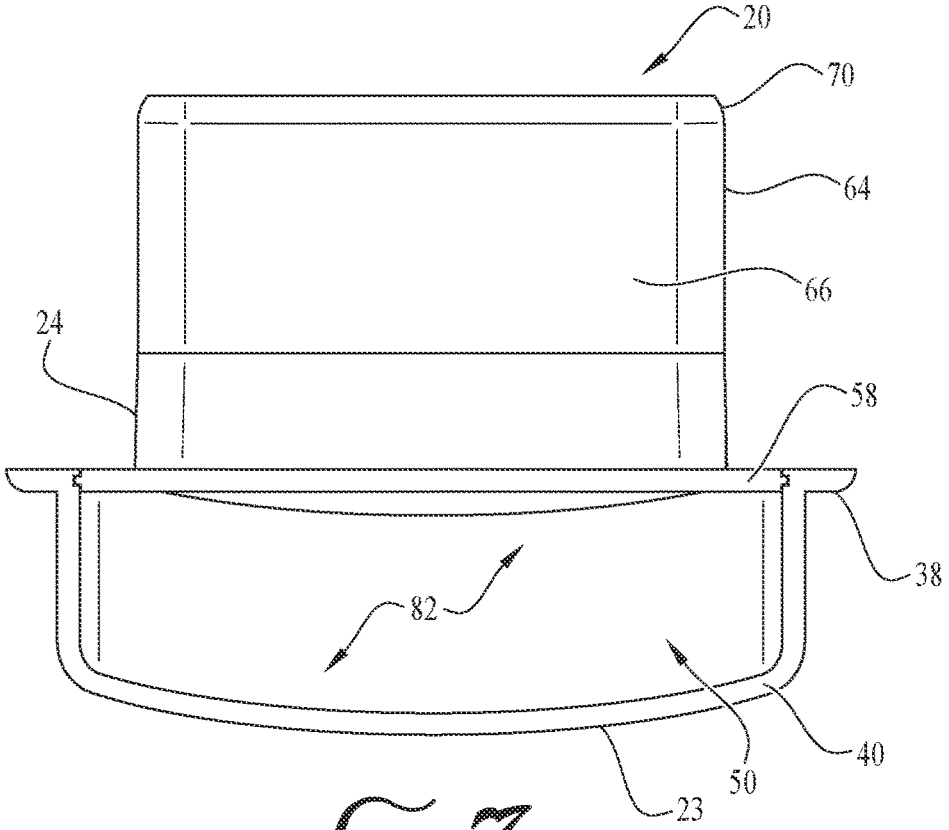
FIG. 7 is an assembled top view of the pool overflow drain heightener of FIG. 1.
Figure 8:
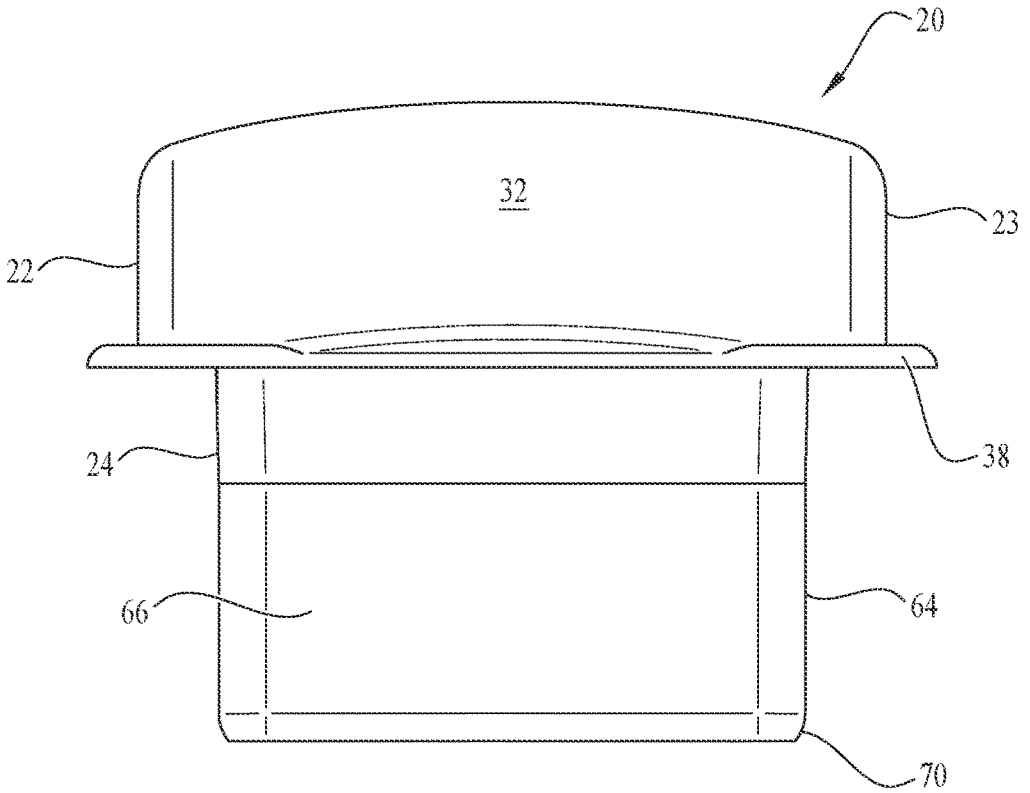
FIG. 8 is an assembled bottom view of the pool overflow drain heightener of FIG. 1.
Figure 9:
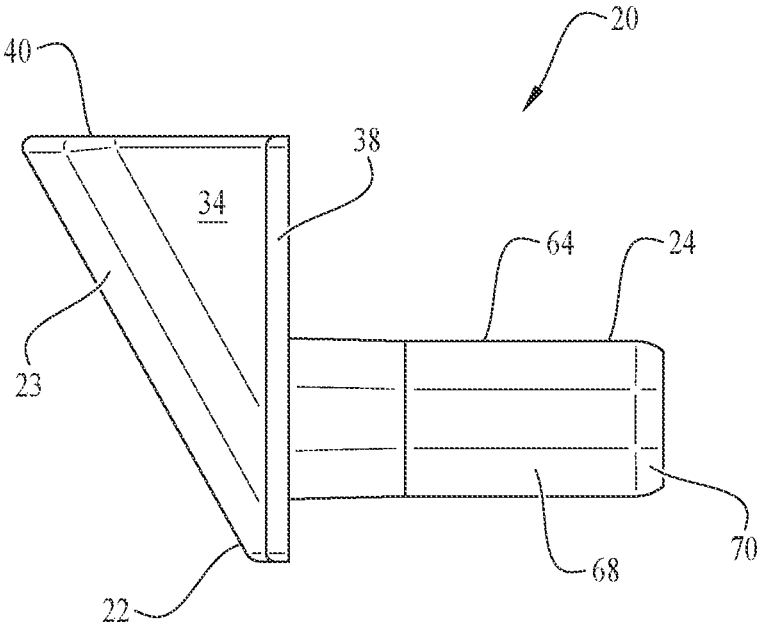
FIG. 9 is an assembled left view of the pool overflow drain heightener of FIG. 1.
Figure 11:
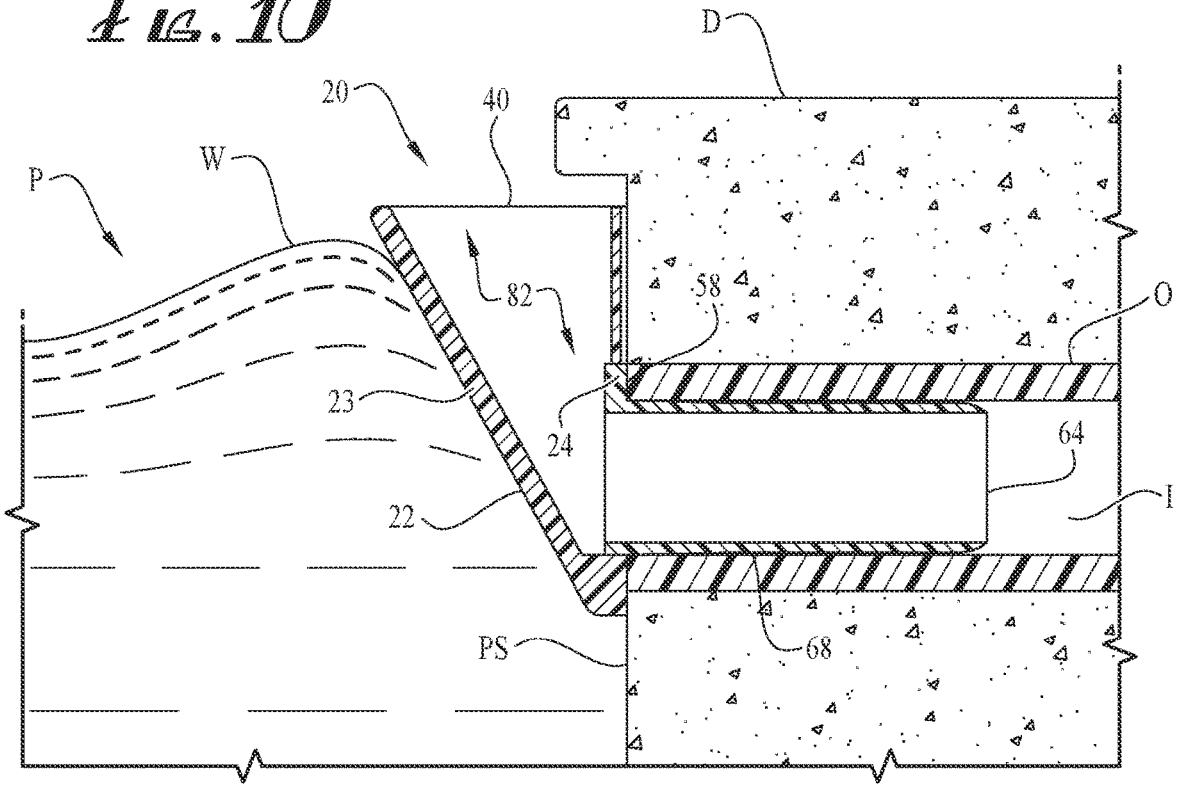
FIG. 11 is an assembled cross-sectional view of the pool overflow drain heightener of FIG. 10, preventing a small wave of water from entering the drainpipe.

In some embodiments, and as best shown in FIGS. 1, 3 & 5, dam wall 23 comprises a front wall 32, a first sidewall 34 adjacent to and connected to front wall 32, and a second sidewall 36 adjacent to and connected to front wall 32 and opposing the first sidewall 34. In some embodiments, and as best shown in FIGS. 7 & 11, front wall 32, first sidewall 34, and second sidewall 36 at least partially define interior volume 82 and upper rim 40 of dam basin component 22 defining a mouth 50 of interior volume 82. In one or more embodiments, interior volume 82 can be further defined by the pool wall, when the pool overflow drain heightener 20 is installed. Although dam wall 23 is depicted as being substantially wedge-shaped or an inverted ramp with dam mouth 50 opening upward, dam wall 23 can be formed into other shapes, such as, e.g., a simple cylindrical wall (a half of a hollow cylinder wall with a semicircular bottom wall), a rectangular box wall, a wall shaped like a parabolic section of a cone (e.g., a half cone or similar), or any other wall shape that is configured to protrude from a pool wall and has upper rim 40 that at least partially defines upwardly facing mouth 50 and an interior volume 82 that can direct water flowing over upper rim 40 toward the overflow drain. In some embodiments, where dam wall 23 is a curved surface, it can comprise only one sidewall.

In one or more embodiments, and as best shown in FIG. 2, a dam basin flange 38 laterally protrudes from a rear portion 42 of dam basin component 22, with dam wall 23 protruding from dam basin flange 38 in the forward direction (e.g., extending away from the pool wall when installed) and an optional sealing face 44 on the rearward (e.g., face toward the pool wall when installed) portion of dam basin flange 38. In some embodiments, one or more attachment points can be located on dam basin flange 38 to facilitate and/or enable attachment of pool overflow drain heightener 20 to a pool overflow drain. For example, such attachment points can be through holes configured to receive a screw that secures to a threaded hole located on a pool overflow drain. Alternatively, such attachment points can be pegs located on sealing face 44 and configured to be pressure-fit inserted into receiving holes located on a pool overflow drain. In addition to or in the alternative of attachment points, sealing face 44 of dam basin flange 38 is configured to face the pool wall when installed, with a sealant (such as a silicone sealant/adhesive or the like) sealing the gaps between sealing face 44 and the pool wall.

In embodiments where a pool overflow drain heightener 20 comprises both dam basin component 22 and drainpipe component 23, and as shown in FIGS. 1 & 2, a drainpipe attachment plate mounting portion 26 is located on rear portion 42 of dam basin component 22 (e.g., a portion of dam basin component 22 configured to face a pool wall when installed). Although there are many methods and designs to attach dam basin component 22 and drainpipe component 24, in the illustrated example embodiment, the two components are attached through a sliding tongue and groove arrangement, with no preference for whether the tongue or the groove is formed on dam basin component 22 or drainpipe component 24. As illustrated, dam basin flange 38 and/or an inner surface of dam wall 23 include vertical grooves as part of the tongue and groove arrangement. Specifically, a first groove 48 is formed on a first inner side 54 of first sidewall 34; and a second groove 49 is formed on a second inner side 56 of second sidewall 36. First groove 48 and second groove 49 are vertically arranged and aligned to simultaneously receive the grooves, as discusses below. Although not illustrated, dam basin flange 38 can include through holes for receiving therethrough a screw which threads into the existing threaded holes provided in the overflow drain for the original grate cover. In embodiments where a pool overflow drain heightener 20 comprises both dam basin component 22 and drainpipe component 23, both dam basin component 22 may also optionally comprise attachment points as disclosed herein.

Figure 6:
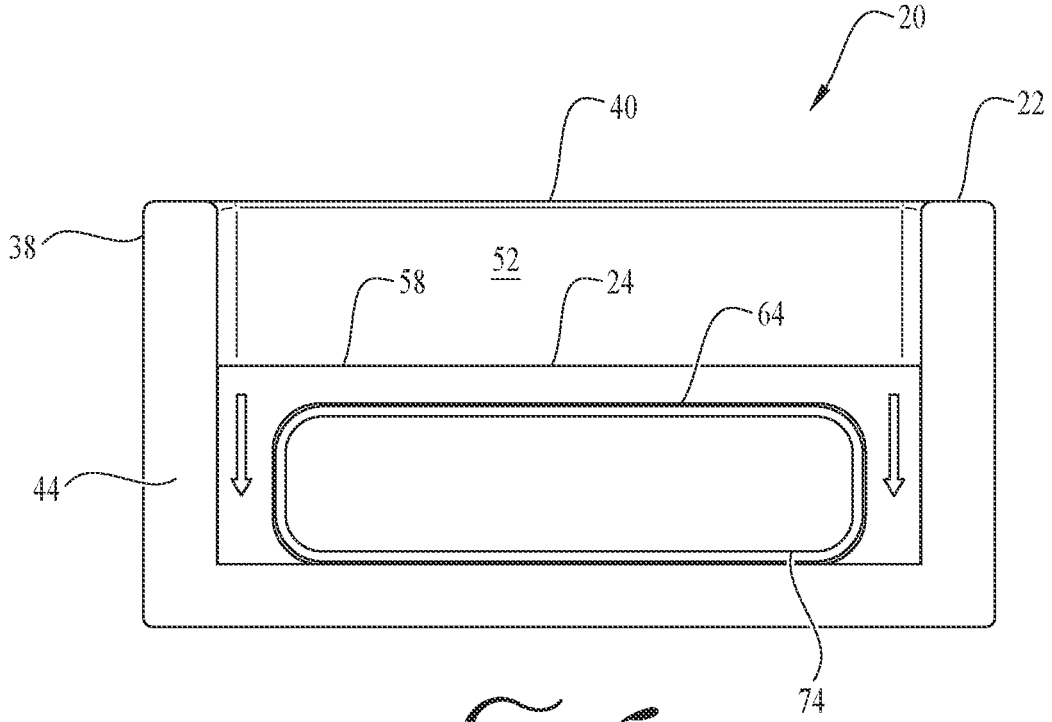
FIG. 6 is an assembled back view of the pool overflow drain heightener of FIG. 1.

In one or more embodiments, and referring to FIGS. 1, 6 & 7, drainpipe component 24 includes a drainpipe attachment plate or flange 58. In some embodiments, and as shown in FIG. 1, drainpipe attachment plate or flange 58 includes a front face 79 opposite a back face 80, where back face 80 is configured to face the pool wall when installed. Drainpipe attachment plate 58 includes a dam basin mounting portion 28, which comprises a first tongue 62 vertically arranged on the edge of drainpipe attachment plate 58 and a second tongue 63 vertically arranged on the edge of drainpipe attachment plate 58 opposite first tongue 62. As shown in FIGS. 1 & 2, when drainpipe component 24 and dam basin component 22 are being connected, first tongue 62 is either slid or otherwise placed into first groove 48; and second tongue 63 is either slid or otherwise placed (e.g., snapped) into the second groove 49. A bottom edge 78 of drainpipe attachment plate 58 contacts or is in close proximity to bottom sill 46 of dam basin flange 38. The assembly of dam basin component 22 and drainpipe component 24 can be held together by a friction fit, a snap fit, adhesive (such as the silicone sealant/adhesive), or be held in engagement in conjunction with the pool wall and the overflow drain. A top edge 76 of dam basin flange 38 is opposite bottom edge 78; and the pool wall can partially define the interior volume above this top edge 78.

Referring to FIGS. 1, 3, & 6-9, a hollow drainpipe connector insert 64 protrudes rearwardly from the drainpipe attachment plate 58. In some embodiments, and as shown in FIGS. 1 & 2, hollow drainpipe connector insert 64 includes a proximal drain inlet 72 formed through the drainpipe attachment plate 58 and a distal drain outlet 74 in fluid communication with the proximal drain inlet 72 through an interior passage 66 formed through the hollow drainpipe connector insert 64. Hollow drainpipe connector insert wall 68 encloses interior passage 66, and, in one or more embodiments, is tapered as it extends distally to ease insertion into the pool overflow drain and to permit a friction fit within the pool overflow drain as hollow drainpipe connector insert 64 is pressed into position within the pool overflow drain. The hollow drainpipe connector insert wall 68 can include a radiused or chamfered leading edge 70 to ease insertion into the pool overflow drain. Hollow drainpipe connector insert 64 provides a rugged support for pool overflow drain heightener 20, so that the assembly remains in position once installed into the pool overflow drain. Further, hollow drainpipe connector insert 64 provides a passage through which overflowing water can travel and be delivered to the overflow drain. Although hollow drainpipe connector insert 64 cross-sectional shape is shown as being rectangular with radiused corners, the shape can be modified in manufacturing to accommodate various shaped drainpipes of overflow drains. Alternatively, hollow drainpipe connector insert 64 does not need to exactly fit the shape of a drainpipe of an overflow drain, as pool overflow drain heightener 20 can be sealed against the pool wall to prevent substantial water entry into the drainpipe regions other than mouth 50.

Figure 10:
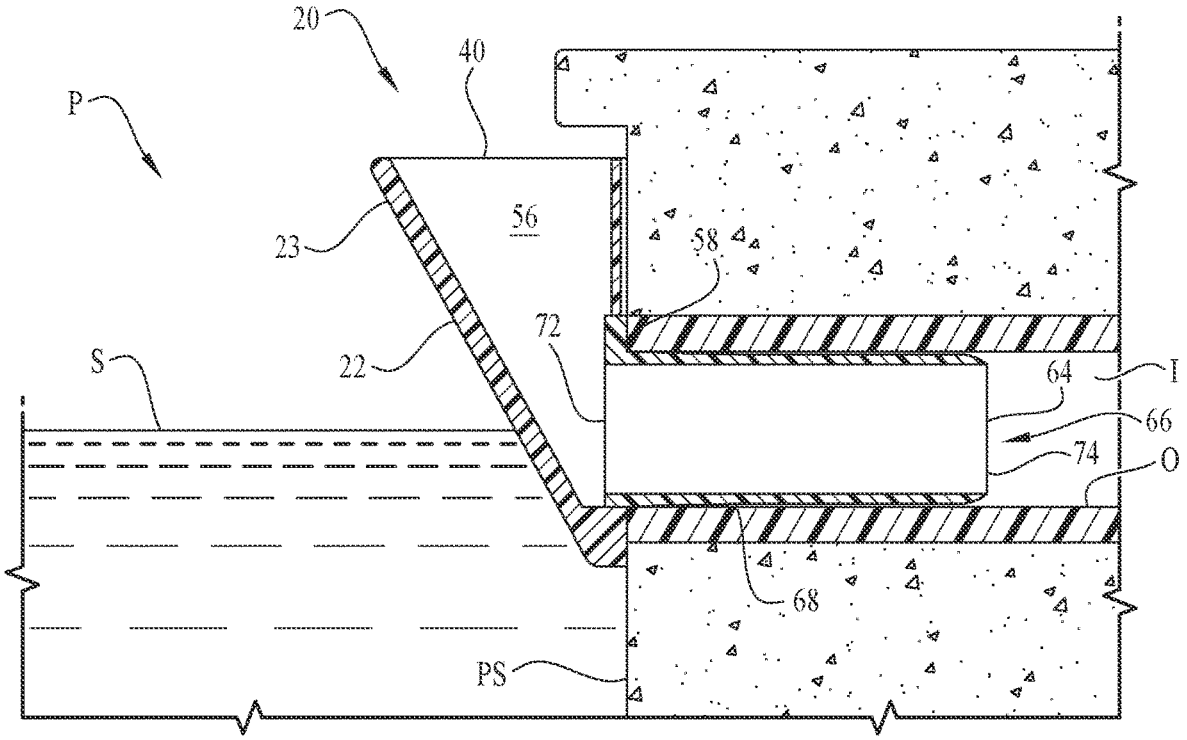
FIG. 10 is an assembled cross-sectional view of the pool overflow drain heightener of FIG. 1, installed within a drainpipe located through the side wall of a pool.

Looking now at FIGS. 10 and 11, an exemplary embodiment of pool overflow drain heightener 20 comprising both dam basin component 22 and drainpipe component 23 is illustrated installed within a drainpipe of a pool overflow drain O within in the sidewall of a swimming pool P. Usually, a grate or the like covers an inlet of pool overflow drain O, and if present, is removed to enable insertion of hollow drainpipe connector insert 64 into pool overflow drain O. Hollow drainpipe connector insert 64 is firmly wedged within pool overflow drain O with tapered hollow drainpipe connector insert wall 68 frictionally engaging an inner wall I of pool overflow drain O. Hollow drainpipe connector insert wall 68 can be further adhered and/or sealed within pool overflow drain O by applying silicone sealant or the like. Drainpipe attachment plate 58 can act like a stop against a pool sidewall PS to indicate to the installer that hollow drainpipe connector insert 64 is fully inserted within pool overflow drain O. Once assembled pool overflow drain heightener 20 is attached to pool overflow drain O (and optionally sealed to pool sidewall PS), a pool P water level is permitted to be filled and/or splashed above the lowest point of overflow drain O without the water draining. It can be seen that a water surface S level in FIG. 10 is an inch or so above the lowest portion of pool overflow drain O, such that the pool level can be slightly increased using the present pool overflow drain heightener 20.

In embodiments where a pool overflow drain heightener 20 comprises dam basin component 22 without drainpipe component 23, installation occurs as described above, by removing a grate or the like that covers an inlet of pool overflow drain O. Pool overflow drain heightener 20 is then secured by affixing it to pool overflow drain O using one or more attachment points located on dam basin flange 38 and/or through use of a water-proof adhesive applied to sealing face 44 or rear portion 42 of dam basin flange 38. Such attachment is done in a manner that aligns sealing face 44 to pool facing perimeter of inner wall I of pool overflow drain O so as to create fluid communication between interior volume 82 of dam basin 23 and inlet of pool overflow drain O. Once installed pool overflow drain heightener 20 to pool overflow drain O (and optionally sealed to pool sidewall PS), a pool P water level is permitted to be filled and/or splashed above the lowest point of overflow drain O without the water draining.

FIG. 11 illustrates a wave W in the water created by ordinary pool use (such as swimming or play) that crests below upper rim 40 of dam wall 23, yet is not permitted to drain. Further, upper rim 40 of dam wall 23 is still positioned well below a deck D level (and below the coping of pool P), so that a flooding event that raises water surface S level above upper rim 40 will permit proper drainage of the water without flooding deck D. As the water rises, it flows over upper rim 40 and into mouth 50 of pool overflow drain heightener 22. The water flows generally down inner side 52 of front wall 32 (and sidewalls 34, 36) into interior volume 82. The water is directed to proximal drain inlet 72, into interior passage 66, and through distal drain outlet 74. Thereafter, the water drains normally through the pool overflow drain O. In this way, a pool owner can enjoy pool P without worrying about excessive water loss due to a mispositioned pool overflow drain O.

Aspects of the present specification may also be described by the following embodiments:

1. A pool overflow drain heightener comprising a dam basin having a front wall, a first sidewall adjacent to and extending from the front wall, a second sidewall adjacent to and extending from the front wall and opposing the first sidewall, where the front wall, the first sidewall, and the second sidewall define an upper rim and a rear portion; and a mounting portion located on the rear portion of the dam basin; wherein, the front wall, the first sidewall, and the second sidewall of the dam basin at least partially define an interior volume with a mouth defined at least partially by the upper rim, the mouth configured to be in fluid communication with the interior volume.
2. The pool overflow drain heightener of embodiment 1 further comprising: a drainpipe attachment plate having a dam basin mounting portion and a hollow drainpipe connector insert with a proximal drain inlet formed through the drainpipe attachment plate and in fluid communication with a distal drain outlet through an interior passage of the hollow drainpipe connector insert, the hollow drainpipe connector insert extending rearwardly from a back face of the drainpipe attachment plate, the dam basin mounting portion configured to be joined to the drainpipe attachment plate mounting portion to couple the dam basin and the drainpipe attachment plate in an assembled configuration; wherein, the mounting portion comprises drainpipe attachment plate mounting portion at the rear portion; wherein, in the assembled configuration, the mouth configured to be in fluid communication with the interior volume, the interior volume configured to be in fluid communication with the proximal drain inlet of the hollow drainpipe connector insert.

3. The pool overflow drain heightener of embodiment 2, wherein an outer wall of the hollow drainpipe connector insert is tapered such that the outer wall converges toward the distal drain outlet.

4. The pool overflow drain heightener of embodiments 2 or 3, wherein the drainpipe attachment plate mounting portion and the dam basin mounting portion form a tongue and groove joint such that the drainpipe attachment plate slides into engagement with the dam basin.

5. The pool overflow drain heightener of any one of embodiments 2-4, wherein the dam basin includes a first inner side of the first sidewall and a second inner side of the second sidewall, the drainpipe attachment plate mounting portion comprising a first groove formed into the first inner side and a second groove formed on the second inner side; and the drainpipe attachment plate includes a first edge opposite a second edge, the dam basin mounting portion comprising a first tongue being formed along the first edge and a second tongue being formed along the second edge; the dam basin and the drainpipe attachment plate configured to be slid into engagement with the first tongue inserted within the first groove and the second tongue inserted into the second groove.

6. The pool overflow drain heightener of any one of embodiments 2-5, wherein, in the assembled configuration, the dam basin forms a funnel with the mouth of the interior volume having a maximum cross-sectional area that converges toward the proximal drain inlet of the hollow drainpipe connector insert.

7. The pool overflow drain heightener of any one of embodiments 2-6, wherein the drainpipe attachment plate comprises a drainpipe flange from which the hollow drainpipe connector insert extends.

8. The pool overflow drain heightener of any one of embodiments 2-7, wherein the rear portion of the dam basin comprises a dam basin flange that extends laterally outward from each of the first sidewall and the second sidewall.

9. The pool overflow drain heightener of any one of embodiments 2-8, wherein the hollow drainpipe connector insert is configured to be inserted into a pool overflow drain, such that the mouth is in fluid communication with the pool overflow drain through the interior volume and the interior passage.

10. The pool overflow drain heightener of any one of embodiments 2-9, wherein an outer wall of the hollow drainpipe connector insert includes a tapered profile such that the outer wall converges toward the distal drain outlet, and wherein the tapered profile enables a friction fit within the pool overflow drain.

11. A pool overflow drain heightener comprising a dam basin having a front wall, a first sidewall adjacent to and extending from the front wall, a second sidewall adjacent to and extending from the front wall and opposing the first sidewall, a dam basin mouth at least partially defined by the front wall, the first sidewall, and the second sidewall, and an interior volume at least partially defined by the front wall, the first sidewall, and the second sidewall, wherein the dam basin mouth is configured to be in fluid communication with the interior volume, and the interior volume is configured to be in fluid communication with a pool drainpipe when installed.

12. The pool overflow drain heightener of embodiment 11 wherein the dam basin further includes a back wall shorter than and opposing the front wall, the pool overflow drain heightener further comprising: a hollow drainpipe connector insert unitarily molded with the dam basin and extending rearwardly from the back wall away from the interior volume, the hollow drainpipe connector insert including a proximal drain inlet formed through the back wall and in fluid communication with a distal drain outlet through an interior passage of the hollow drainpipe connector insert.

13. The pool overflow drain heightener of embodiment 12, wherein an outer wall of the hollow drainpipe connector insert is tapered such that the outer wall converges toward the distal drain outlet.

14. The pool overflow drain heightener of embodiments 12 or 13, further comprising a dam basin flange that extends laterally outward from each of the first sidewall and the second sidewall.

15. The pool overflow drain heightener of any one of embodiments 12-14, wherein the hollow drainpipe connector insert is configured to be inserted into a pool overflow drain, such that the mouth is in fluid communication with the pool overflow drain through the interior volume and the interior passage.

16. The pool overflow drain heightener of any one of embodiments 12-15, wherein an outer wall of the hollow drainpipe connector insert includes a tapered profile such that the outer wall converges toward the distal drain outlet, and wherein the tapered profile enables a friction fit within the pool overflow drain.

17. A pool overflow drain heightener kit comprising a first height dam basin having a first dam wall and a second height dam basin having a second dam wall, the first dam wall being higher than the second dam wall; each of the first height dam basin and the second height dam basin comprising a front wall, a first sidewall adjacent to and extending from the front wall, a second sidewall adjacent to and extending from the front wall and opposing the first sidewall, a dam basin mouth at least partially defined by the front wall, the first sidewall, and the second sidewall; and a drainpipe attachment plate having a dam basin mounting portion and a hollow drainpipe connector insert with a proximal drain inlet formed through the drainpipe attachment plate and in fluid communication with a distal drain outlet through an interior passage of the hollow drainpipe connector insert, the hollow drainpipe connector insert extending rearwardly from a back face of the drainpipe attachment plate, the dam basin mounting portion configured to be joined to the drainpipe attachment plate mounting portion to couple the dam basin and the drainpipe attachment plate in an assembled configuration; wherein, in the assembled configuration, the front wall, the first sidewall, and the second sidewall of the dam basin and a front face of the drainpipe attachment plate at least partially define a dam basin interior volume with a dam basin mouth defined at least partially by the upper rim, the mouth configured to be in fluid communication with the interior volume, the interior volume configured to be in fluid communication with the proximal drain inlet of the hollow drainpipe connector insert.

18. The pool overflow drain heightener kit of embodiment 17, wherein the drainpipe attachment plate mounting portion and the dam basin mounting portion form a tongue and groove joint such that the drainpipe attachment plate is configured to interchangeably slide into engagement selectively with each the first height dam basin and the second height dam basin.

19. The pool overflow drain heightener kit of embodiments 17 or 18, wherein each of the first height dam basin the second height dam basin includes a first inner side of the first sidewall and a second inner side of the second sidewall, the drainpipe attachment plate mounting portion comprising a first groove formed into the first inner side and a second groove formed on the second inner side; the drainpipe attachment plate includes a first edge opposite a second edge, the dam basin mounting portion comprising a first tongue being formed along the first edge and a second tongue being formed along the second edge; and each of the first height dam basin the second height dam basin and the drainpipe attachment plate are configured to be individually and selectively slid into engagement with the first tongue inserted within the first groove and the second tongue inserted into the second groove.

20. The pool overflow drain heightener kit of any one of embodiments 17-19, wherein the hollow drainpipe connector insert is configured to be inserted into a pool overflow drain, such that the mouth is in fluid communication with the pool overflow drain through the interior volume and the interior passage.

21. The pool overflow drain heightener kit of any one of embodiments 17-20, wherein an outer wall of the hollow drainpipe connector insert includes a tapered profile such that the outer wall converges toward the distal drain outlet, and wherein the tapered profile enables a friction fit within the pool overflow drain.

22. The pool overflow drain heightener kit of any one of embodiments 17-21, wherein in the assembled configuration, each of the first height dam basin the second height dam basin forms a funnel with the mouth of the interior volume having a maximum cross-sectional area that converges toward the proximal drain inlet of the hollow drainpipe connector insert.

In closing, foregoing descriptions of embodiments of the present invention have been presented for the purposes of illustration and description. It is to be understood that, although aspects of the present invention are highlighted by referring to specific embodiments, one skilled in the art will readily appreciate that these described embodiments are only illustrative of the principles comprising the present invention. As such, the specific embodiments are not intended to be exhaustive or to limit the invention to the precise forms disclosed. Therefore, it should be understood that embodiments of the disclosed subject matter are in no way limited to a particular element, compound, composition, component, article, apparatus, methodology, use, protocol, step, and/or limitation described herein, unless expressly stated as such.

In addition, groupings of alternative embodiments, elements, steps and/or limitations of the present invention are not to be construed as limitations. Each such grouping may be referred to and claimed individually or in any combination with other groupings disclosed herein. It is anticipated that one or more alternative embodiments, elements, steps and/or limitations of a grouping may be included in, or deleted from, the grouping for reasons of convenience and/or patentability. When any such inclusion or deletion occurs, the specification is deemed to contain the grouping as modified, thus fulfilling the written description of all Markush groups used in the appended claims.

Furthermore, those of ordinary skill in the art will recognize that certain changes, modifications, permutations, alterations, additions, subtractions, and sub-combinations thereof can be made in accordance with the teachings herein without departing from the spirit of the present invention. Furthermore, it is intended that the following appended claims and claims hereafter introduced are interpreted to include all such changes, modifications, permutations, alterations, additions, subtractions, and sub-combinations as are within their true spirit and scope. Accordingly, the scope of the present invention is not to be limited to that precisely as shown and described by this specification.

Certain embodiments of the present invention are described herein, including the best mode known to the inventors for carrying out the invention. Of course, variations on these described embodiments will become apparent to those of ordinary skill in the art upon reading the foregoing description. The inventor expects skilled artisans to employ such variations as appropriate, and the inventors intend for the present invention to be practiced otherwise than specifically described herein. Accordingly, this invention includes all modifications and equivalents of the subject matter recited in the claims appended hereto as permitted by applicable law. Moreover, any combination of the above-described embodiments in all possible variations thereof is encompassed by the invention unless otherwise indicated herein or otherwise clearly contradicted by context.

The words, language, and terminology used in this specification is for the purpose of describing particular embodiments, elements, steps and/or limitations only and is not intended to limit the scope of the present invention, which is defined solely by the claims. In addition, such words, language, and terminology are to be understood not only in the sense of their commonly defined meanings, but to include by special definition in this specification structure, material or acts beyond the scope of the commonly defined meanings. Thus, if an element, step, or limitation can be understood in the context of this specification as including more than one meaning, then its use in a claim must be understood as being generic to all possible meanings supported by the specification and by the word itself.

The definitions and meanings of the elements, steps or limitations recited in a claim set forth below are, therefore, defined in this specification to include not only the combination of elements, steps or limitations which are literally set forth, but all equivalent structure, material or acts for performing substantially the same function in substantially the same way to obtain substantially the same result. In this sense it is therefore contemplated that an equivalent substitution of two or more elements, steps or limitations may be made for any one of the elements, steps or limitations in a claim set forth below or that a single element, step, or limitation may be substituted for two or more elements, steps, or limitations in such a claim. Although elements, steps or limitations may be described above as acting in certain combinations and even initially claimed as such, it is to be expressly understood that one or more elements, steps or limitations from a claimed combination can in some cases be excised from the combination and that the claimed combination may be directed to a sub-combination or variation of a sub-combination. As such, notwithstanding the fact that the elements, steps and/or limitations of a claim are set forth below in a certain combination, it must be expressly understood that the invention includes other combinations of fewer, more, or different elements, steps and/or limitations, which are disclosed in above even when not initially claimed in such combinations. Furthermore, insubstantial changes from the claimed subject matter as viewed by a person with ordinary skill in the art, now known or later devised, are expressly contemplated as being equivalently within the scope of the claims. Therefore, obvious substitutions now or later known to one with ordinary skill in the art are defined to be within the scope of the defined elements. Accordingly, the claims are thus to be understood to include what is specifically illustrated and described above, what is conceptually equivalent, what can be obviously substituted and also what essentially incorporates the essential idea of the invention.

Unless otherwise indicated, all numbers expressing a characteristic, item, quantity, parameter, property, term, and so forth used in the present specification and claims are to be understood as being modified in all instances by the term "about." As used herein, the term "about" means that the characteristic, item, quantity, parameter, property, or term so qualified encompasses a range of plus or minus ten percent above and below the value of the stated characteristic, item, quantity, parameter, property, or term. Accordingly, unless indicated to the contrary, the numerical parameters set forth in the specification and attached claims are approximations that may vary. For instance, as mass spectrometry instruments can vary slightly in determining the mass of a given analyte, the term "about" in the context of the mass of an ion or the mass/charge ratio of an ion refers to +/−0.50 atomic mass unit. At the very least, and not as an attempt to limit the application of the doctrine of equivalents to the scope of the claims, each numerical indication should at least be construed in light of the number of reported significant digits and by applying ordinary rounding techniques.

Notwithstanding that the numerical ranges and values setting forth the broad scope of the invention are approximations, the numerical ranges and values set forth in the specific examples are reported as precisely as possible. Any numerical range or value, however, inherently contains certain errors necessarily resulting from the standard deviation found in their respective testing measurements. Recitation of numerical ranges of values herein is merely intended to serve as a shorthand method of referring individually to each separate numerical value falling within the range. Unless otherwise indicated herein, each individual value of a numerical range is incorporated into the present specification as if it were individually recited herein.

Use of the terms "may" or "can" in reference to an embodiment or aspect of an embodiment also carries with it the alternative meaning of "may not" or "cannot." As such, if the present specification discloses that an embodiment or an aspect of an embodiment may be or can be included as part of the inventive subject matter, then the negative limitation or exclusionary proviso is also explicitly meant, meaning that an embodiment or an aspect of an embodiment may not be or cannot be included as part of the inventive subject matter. In a similar manner, use of the term "optionally" in reference to an embodiment or aspect of an embodiment means that such embodiment or aspect of the embodiment may be included as part of the inventive subject matter or may not be included as part of the inventive subject matter. Whether such a negative limitation or exclusionary proviso applies will be based on whether the negative limitation or exclusionary proviso is recited in the claimed subject matter.

The terms "a," "an," "the" and similar references used in the context of describing the present invention (especially in the context of the following claims) are to be construed to cover both the singular and the plural, unless otherwise indicated herein or clearly contradicted by context. Further, ordinal indicators—such as, e.g., "first," "second," "third," etc. — for identified elements are used to distinguish between the elements, and do not indicate or imply a required or limited number of such elements, and do not indicate a particular position or order of such elements unless otherwise specifically stated. All methods described herein can be performed in any suitable order unless otherwise indicated herein or otherwise clearly contradicted by context. The use of any and all examples or exemplary language (e.g., "such as") provided herein is intended merely to better illuminate the present invention and does not pose a limitation on the scope of the invention otherwise claimed. No language in the present specification should be construed as indicating any non-claimed element essential to the practice of the invention.

When used in the claims, whether as filed or added per amendment, the open-ended transitional term "comprising", variations thereof such as, e.g., "comprise" and "comprises", and equivalent open-ended transitional phrases thereof like "including," "containing" and "having", encompass all the expressly recited elements, limitations, steps, integers, and/or features alone or in combination with unrecited subject matter; the named elements, limitations, steps, integers, and/or features are essential, but other unnamed elements, limitations, steps, integers, and/or features may be added and still form a construct within the scope of the claim. Specific embodiments disclosed herein may be further limited in the claims using the closed-ended transitional phrases "consisting of" or "consisting essentially of" (or variations thereof such as, e.g., "consist of", "consists of", "consist essentially of", and "consists essentially of") in lieu of or as an amendment for "comprising." When used in the claims, whether as filed or added per amendment, the closed-ended transitional phrase "consisting of" excludes any element, limitation, step, integer, or feature not expressly recited in the claims. The closed-ended transitional phrase "consisting essentially of" limits the scope of a claim to the expressly recited elements, limitations, steps, integers, and/or features and any other elements, limitations, steps, integers, and/or features that do not materially affect the basic and novel characteristic(s) of the claimed subject matter. Thus, the meaning of the open-ended transitional phrase "comprising" is being defined as encompassing all the specifically recited elements, limitations, steps and/or features as well as any optional, additional unspecified ones. The meaning of the closed-ended transitional phrase "consisting of" is being defined as only including those elements, limitations, steps, integers, and/or features specifically recited in the claim, whereas the meaning of the closed-ended transitional phrase "consisting essentially of" is being defined as only including those elements, limitations, steps, integers, and/or features specifically recited in the claim and those elements, limitations, steps, integers, and/or features that do not materially affect the basic and novel characteristic(s) of the claimed subject matter. Therefore, the open-ended transitional phrase "comprising" (and equivalent open-ended transitional phrases thereof) includes within its meaning, as a limiting case, claimed subject matter specified by the closed-ended transitional phrases "consisting of" or "consisting essentially of." As such, the embodiments described herein or so claimed with the phrase "comprising" expressly and unambiguously provide description, enablement, and support for the phrases "consisting essentially of" and "consisting of."

Lastly, all patents, patent publications, and other references cited and identified in the present specification are individually and expressly incorporated herein by reference in their entirety for the purpose of describing and disclosing, for example, the compositions and methodologies described in such publications that might be used in connection with the present invention. These publications are provided solely for their disclosure prior to the filing date of the present application. Nothing in this regard is or should be construed as an admission that the inventors are not entitled to antedate such disclosure by virtue of prior invention or for any other reason. All statements as to the date or representation as to the contents of these documents are based on the information available to the applicant and do not constitute any admission as to the correctness of the dates or contents of these documents.

The invention claimed is:

1. A pool overflow drain heightener comprising:

a dam basin having a front wall, a first sidewall adjacent to and extending from the front wall, a second sidewall adjacent to and extending from the front wall and opposing the first sidewall, and a drainpipe attachment plate mounting portion, the front wall, the first sidewall, and the second sidewall defining an upper rim and a rear portion; and the drainpipe attachment plate mounting portion being located on the rear portion of the dam basin; and a drainpipe component having a dam basin mounting portion and a hollow drainpipe connector insert with a proximal drain inlet formed through the drainpipe component and in fluid communication with a distal drain outlet through an interior passage of the hollow drainpipe connector insert, the hollow drainpipe connector insert extending rearwardly from a back face of the drainpipe component, the dam basin mounting portion configured to be joined to the drainpipe attachment plate mounting portion to couple the dam basin and the drainpipe component in an assembled configuration;

wherein, the front wall, the first sidewall, and the second sidewall of the dam basin at least partially define an interior volume with a mouth defined at least partially by the upper rim, the mouth configured to be in fluid communication with the interior volume; and wherein, in the assembled configuration, the mouth configured to be in fluid communication with the interior volume, the interior volume configured to be in fluid communication with the proximal drain inlet of the hollow drainpipe connector insert.

2. The pool overflow drain heightener of claim 1, wherein an outer wall of the hollow drainpipe connector insert is tapered such that the outer wall converges toward the distal drain outlet.

3. The pool overflow drain heightener of claim 1, wherein the drainpipe attachment plate mounting portion and the dam basin mounting portion form a tongue and groove joint such that the drainpipe component slides into engagement with the dam basin.

4. The pool overflow drain heightener of claim 2 wherein:

the dam basin includes a first inner side of the first sidewall and a second inner side of the second sidewall, the drainpipe attachment plate mounting portion comprising a first groove formed into the first inner side and a second groove formed on the second inner side; and the drainpipe component includes a first edge opposite a second edge, the dam basin mounting portion comprising a first tongue being formed along the first edge and a second tongue being formed along the second edge;

the dam basin and the drainpipe component configured to be slid into engagement with the first tongue inserted within the first groove and the second tongue inserted into the second groove.

5. The pool overflow drain heightener of claim 1, wherein, in the assembled configuration, the dam basin forms a funnel with the mouth of the interior volume having a maximum cross-sectional area that converges toward the proximal drain inlet of the hollow drainpipe connector insert.

6. The pool overflow drain heightener of claim 1, wherein the drainpipe component comprises a drainpipe flange from which the hollow drainpipe connector insert extends.

7. The pool overflow drain heightener of claim 1, wherein the rear portion of the dam basin comprises a dam basin flange that extends laterally outward from each of the first sidewall and the second sidewall.

8. The pool overflow drain heightener of claim 1, wherein the hollow drainpipe connector insert is configured to be inserted into a pool overflow drain, such that the mouth is in fluid communication with the pool overflow drain through the interior volume and the interior passage.

9. The pool overflow drain heightener of claim 8, wherein an outer wall of the hollow drainpipe connector insert includes a tapered profile such that the outer wall converges toward the distal drain outlet, and wherein the tapered profile enables a friction fit within the pool overflow drain.

10. A pool overflow drain heightener comprising:

a dam basin having a front wall, a first sidewall adjacent to and extending from the front wall, a second sidewall adjacent to and extending from the front wall and opposing the first sidewall, a dam basin mouth at least partially defined by the front wall, the first sidewall, and the second sidewall, and an interior volume at least partially defined by the front wall, the first sidewall, and the second sidewall, a hollow drainpipe connector insert unitarily molded with the dam basin and extending rearwardly from the back wall away from the interior volume, the hollow drainpipe connector insert including a proximal drain inlet formed through the back wall and in fluid communication with a distal drain outlet through an interior passage of the hollow drainpipe connector insert;

wherein a back wall shorter than and opposing the front wall; and wherein the dam basin mouth is configured to be in fluid communication with the interior volume, and the interior volume is configured to be in fluid communication with a pool drainpipe when installed.

11. The pool overflow drain heightener of claim 10, wherein an outer wall of the hollow drainpipe connector insert is tapered such that the outer wall converges toward the distal drain outlet.

12. The pool overflow drain heightener of claim 10, further comprising a dam basin flange that extends laterally outward from each of the first sidewall and the second sidewall.

13. The pool overflow drain heightener of claim 10, wherein the hollow drainpipe connector insert is configured to be inserted into a pool overflow drain, such that the mouth is in fluid communication with the pool overflow drain through the interior volume and the interior passage.

14. The pool overflow drain heightener of claim 13, wherein an outer wall of the hollow drainpipe connector insert includes a tapered profile such that the outer wall converges toward the distal drain outlet, and wherein the tapered profile enables a friction fit within the pool overflow drain.

15. A pool overflow drain heightener kit comprising:

a first height dam basin having a first dam wall and a second height dam basin having a second dam wall, the first dam wall being higher than the second dam wall;

each of the first height dam basin and the second height dam basin comprising a front wall, a first sidewall adjacent to and extending from the front wall, a second sidewall adjacent to and extending from the front wall and opposing the first sidewall, a dam basin mouth at least partially defined by the front wall, the first sidewall, and the second sidewall; and a drainpipe component comprising a drainpipe attachment plate having a dam basin mounting portion and a hollow drainpipe connector insert with a proximal drain inlet formed through the drainpipe attachment plate and in fluid communication with a distal drain outlet through an interior passage of the hollow drainpipe connector insert, the hollow drainpipe connector insert extending rearwardly from a back face of the drainpipe attachment plate, the dam basin mounting portion configured to be joined to the drainpipe attachment plate mounting portion to couple the first height dam basin or the second height dam basin and the drainpipe component in an assembled configuration;

wherein, in the assembled configuration, the front wall, the first sidewall, and the second sidewall of the first height dam basin or the second height dam basin and a front face of the drainpipe attachment plate at least partially define a dam basin interior volume with a dam basin mouth defined at least partially by the upper rim, the mouth configured to be in fluid communication with the interior volume, the interior volume configured to be in fluid communication with the proximal drain inlet of the hollow drainpipe connector insert.

16. The pool overflow drain heightener of claim 15, wherein the drainpipe attachment plate mounting portion and the dam basin mounting portion form a tongue and groove joint such that the drainpipe attachment plate is configured to interchangeably slide into engagement selectively with each the first height dam basin and the second height dam basin.

17. The pool overflow drain heightener of claim 16, wherein:

each of the first height dam basin the second height dam basin includes a first inner side of the first sidewall and a second inner side of the second sidewall, the drainpipe attachment plate mounting portion comprising a first groove formed into the first inner side and a second groove formed on the second inner side;

the drainpipe attachment plate includes a first edge opposite a second edge, the dam basin mounting portion comprising a first tongue being formed along the first edge and a second tongue being formed along the second edge; and each of the first height dam basin the second height dam basin and the drainpipe attachment plate are configured to be individually and selectively slid into engagement with the first tongue inserted within the first groove and the second tongue inserted into the second groove.

18. The pool overflow drain heightener of claim 17, wherein the hollow drainpipe connector insert is configured to be inserted into a pool overflow drain, such that the mouth is in fluid communication with the pool overflow drain through the interior volume and the interior passage.

19. The pool overflow drain heightener of claim 18, wherein an outer wall of the hollow drainpipe connector insert includes a tapered profile such that the outer wall converges toward the distal drain outlet, and wherein the tapered profile enables a friction fit within the pool overflow drain.

20. The pool overflow drain heightener of claim 15, wherein, in the assembled configuration, each of the first height dam basin the second height dam basin forms a funnel with the mouth of the interior volume having a maximum cross-sectional area that converges toward the proximal drain inlet of the hollow drainpipe connector insert.

* * * * *